US005611543A

United States Patent [19]

Bottelsen

[11] Patent Number: 5,611,543

[45] Date of Patent: Mar. 18, 1997

[54] NO BOUNCE DART WITH ROTATABLE BARREL

[76] Inventor: Walter E. Bottelsen, 945 W. McCoy La., Santa Maria, Calif. 93455

[21] Appl. No.: 442,493

[22] Filed: May 16, 1995

[51] Int. Cl.[6] ..... A63B 15/02

[52] U.S. Cl. ..... 473/582

[58] Field of Search ..... 273/416, 419, 273/420

[56] References Cited

U.S. PATENT DOCUMENTS

| | | | |
|---|---|---|---|
| 4,230,322 | 10/1980 | Bottelsen | 273/420 |
| 4,697,815 | 10/1987 | McKenna | 273/420 |
| 5,009,433 | 4/1991 | Reid | 273/419 |
| 5,248,151 | 9/1993 | Pickup | 273/420 |
| 5,419,567 | 5/1995 | Orav | 273/420 |

FOREIGN PATENT DOCUMENTS

| | | | |
|---|---|---|---|
| 2180461 | 4/1987 | United Kingdom | 273/419 |
| 2192804A | 1/1988 | United Kingdom . | |
| 2228211 | 8/1990 | United Kingdom | 273/419 |
| 2240048A | 7/1991 | United Kingdom . | |
| 86/01418 | 3/1986 | WIPO | 273/419 |

*Primary Examiner*—Paul E. Shapiro

*Attorney, Agent, or Firm*—Christie, Parker & Hale, LLP

[57] ABSTRACT

A no bounce dart comprises a point which is provided frictionally slidable movement between an extended position and a retracted position relative to the barrel. The barrel is afforded rotatable movement about the point when the dart is engaged in a target.

13 Claims, 3 Drawing Sheets

NO BOUNCE DART WITH ROTATABLE BARREL

FIELD OF THE INVENTION

This invention relates to darts, in particular to a new and improved no bounce dart.

BACKGROUND OF THE INVENTION

In a dart game, a dart is thrown at a target marked on a dart board. Typically the scoring areas are outlined by a wire grid on the face of the target. When a dart point strikes a wire, the dart is deflected and often does not stick in the target, that is, the dart bounces off and lands on the floor. When this occurs, the dart player scores no points and the darts are often damaged or the points dulled by hitting the floor.

U.S. Pat. No. 4,230,322, to Bottelsen, discloses a no bounce dart having a point slidably mounted at the front end of the barrel. On impact with the target, the momentum of the body causes the point to slide from an extended position to a retracted position wherein the barrel impacts the rearward end of the point and hammers the point into the target. A mechanism is provided to frictionally retard the sliding movement of the point within the barrel so that the hammering action of the barrel does not occur until the tip of the point has had time to move off of the wire obstruction.

If a thrown dart impacts another dart already stuck in the target, the thrown dart is often deflected and will either not stick in the target or will miss its intended destination. Furthermore, the previously thrown dart may be knocked off the target. To minimize this effect, it is desirable for the flight of the dart to be able to rotate about the point. In this way, the flight of a previously thrown dart impacted by a subsequently thrown dart may rotate out of the way, minimizing any deflection of the subsequently thrown dart. However, it is not desirable for the barrel to dangle loosely on the point. If this is allowed to occur, a subsequently thrown dart which hits directly on the barrel or shaft may create a springboard effect and may be severely deflected away from its intended destination.

SUMMARY OF THE INVENTION

This invention provides a no bounce dart wherein the point of the dart is afforded frictionally slidable movement between an extended position and a retracted position and wherein the barrel is afforded rotatable movement about the point.

The dart comprises a barrel having an axial bore at is forward end. An insert is mounted at the forward end of the barrel having a sleeve which extends into the bore of the barrel. The insert has an axial passage way in which the shaft of a point is slidably mounted. Means are provided for frictionally retarding the slidable lengthwise movement of the point from an extended position to a retracted position. In the retracted position, the wall of the barrel at the rearward end of the bore engages the rearward end of the point. Means are also provided for allowing the barrel to rotate freely about the shaft of the point when the point is in its retracted position.

In a preferred embodiment of the invention, the frictionally retarding means comprises a collar mounted at the rearward end of the point shaft. The collar comprises at least one tine extending rearwardly and outwardly to frictionally engage and to exert spring force on the inner wall of the sleeve. In its retracted position, the rearward end of the point and the collar extend sufficiently out of the sleeve to afford the shaft and collar rotatable movement relative to the sleeve. In such a position, the sleeve supports the rearward end of the shaft preventing lateral wobbling movement of the barrel relative to the shaft.

In a preferred embodiment of the invention, the collar is afforded rotatable movement about the point shaft so that the barrel may rotate relative to the point shaft no matter what position the point is in.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1:
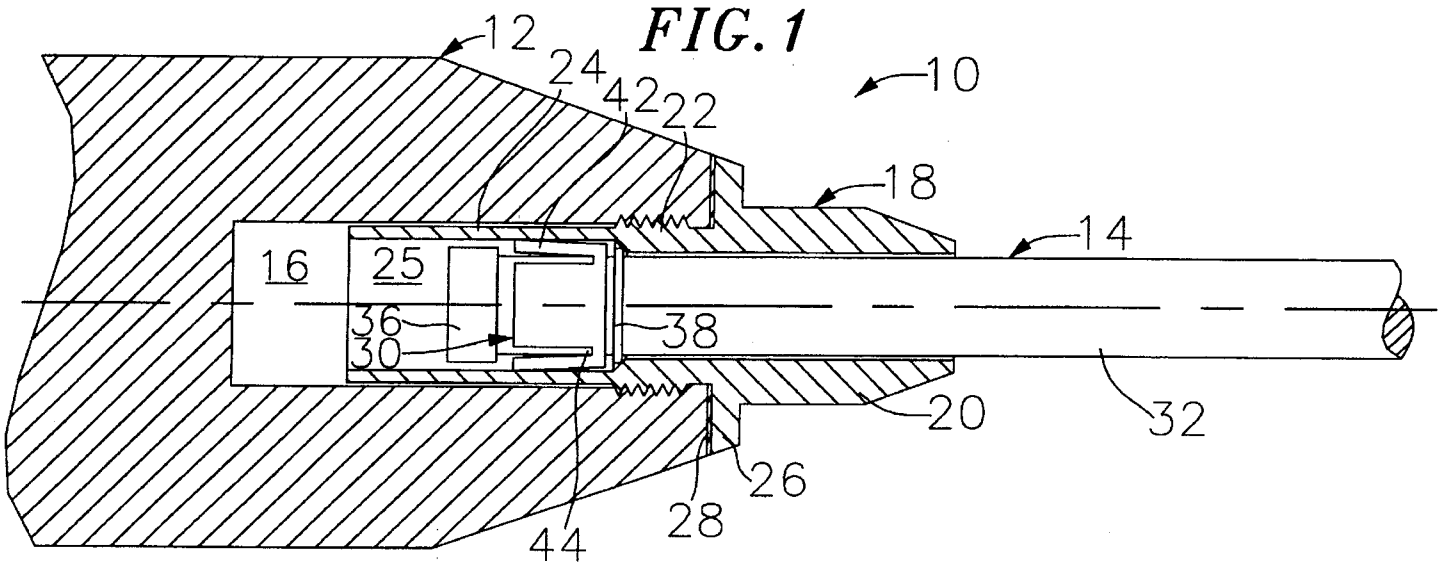
FIG. 1 is a longitudinal cross-sectional cut-away view of a presently preferred embodiment of the invention wherein the point is in its extended position.
Figure 2:
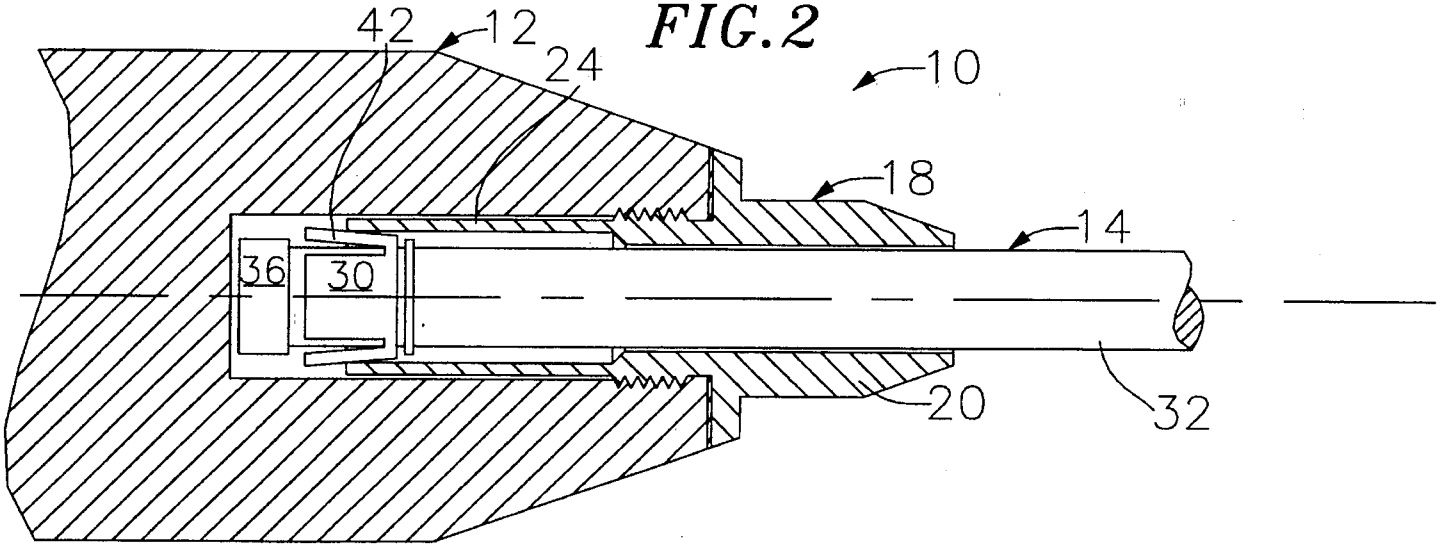
FIG. 2 is a longitudinal cross-sectional cut-away view of a presently preferred embodiment of the invention; wherein the point is in its retracted position.

A preferred embodiment of the present invention is shown in FIGS. 1 and 2. The dart 10 comprises a barrel 12, a point 14 at the forward end of the barrel 12, a shaft (not shown) at the rearward end of the barrel in a flight (not shown) at the rearward end of the shaft. The barrel 12 has an axial bore 16 at its forward end. The forward end of the bore 16 is tapped to receive the threaded portion of an insert 18. The insert 18 has a forward portion 20 external of the bore, a middle threaded portion 22 and a cylindrical sleeve 24 which extends rearwardly into the bore 16. An axial passageway 25 extends the length of the insert 18. The point 14 has a generally cylindrical shaft 32, a tip at the forward end of the shaft 32 and an enlarged head 36 at the rearward end of the shaft 32.

The forward portion 20 of the insert 18 is generally conical shaped, having an annular shoulder 26 which, when the insert 12 is threaded into the bore 16, abuts an annular forward surface of the barrel 12. It is presently preferred that an annular ring of double stick tape 28 be positioned between the shoulder 26 and forward surface of the barrel to prevent unwanted loosening of the insert over time relative to the barrel 12. A presently preferred double stick tape in 1.0 millimeters in thickness is manufactured by Avery Dennison Corporation and sold under the trade name Fastape 445.

The forward portion 20 of the insert 18 has an inner diameter slightly larger, e.g. about 0.002 inch, than the diameter of the point shaft 32 to allow rotation of the shaft 32 but to prevent any significant lateral movement of the point shaft 32.

The sleeve 24 of the insert has an inner diameter larger than the inner diameter of the forward portion 20 of the insert 18 which is selected to receive and frictionally engage a collar 30 mounted at the rearward of the point shaft 32.

The point 14 is slidably and rotatably mounted within the passageway 25 of the insert 18. Just forward of the head 36 of the point 14 is an annular collar 30 which freely rotates about the shaft 32. The collar 30 is fixed in position along the length of the shaft 32 between the enlarged head 34 and a retaining ring or clip 38 which lies in a circumferential groove 40 in the shaft 32.

The collar 30 comprises four tines 42 separated by slits 44 which extend rearwardly from the forward part of the collar 30. At least a pair of opposing tines 42 flare outwardly so that the diameter of the collar 30 at its rearward end (as defined by the outwardly flaring tines) is greater than at its forward end. The diameter of the collar 30 at its forward end is slightly less than the inner diameter of the sleeve 24. The diameter of the collar 30 at its rearward end is slightly greater than the inner diameter of the sleeve 24. When the collar 30 is completely within the sleeve 24, the tines 42 frictionally engage the sleeve 24, acting as springs by exerting a force radially outwardly against the inner wall of the sleeve 24.

In this arrangement, the shaft 32 of the point 14 is afforded slidable lengthwise movement through the sleeve 24 from an extended position as shown in FIG. 1 to a retracted position as shown in FIG. 2. The rate of movement of the point shaft 32 within the sleeve 24 is controlled by the amount of friction generated between the collar tines 42 and the inner wall of the sleeve 24. At the same time, the point shaft 32 is afforded rotatable movement within the collar 30.

The length of the sleeve is preferably selected to be about twice the width of a wire or staple on the dart board. This arrangement has been found to provide optimum slowing of the point shaft as it moves from its extended position to its retracted position.

In the embodiment shown, the depth of the bore in the barrel is greater than the length of the sleeve. As shown in FIG. 2, the depth of the bore is selected to allow the rearward end of the tip to extend sufficiently beyond the sleeve when the tip is in its retracted position to allow the forward end of the collar to rotate within the sleeve. This arrangement, the sleeve still supports the collar and point shaft preventing lateral wobbling of the barrel, but affords additional freedom of rotation of the barrel about the point after the dart has impacted a target.

It is also understood that, if rotational movement of the point is not desired except when it is in its retracted position, rotational movement in other positions may be prevented by simply fixing, e.g., gluing, the collar to the shaft of the point.

In a particularly preferred embodiment, the length of the point is about 1.5 inches the diameter of the point shaft is about 0.092 inch. The length of the sleeve is about 0.49 inch and the inner diameter of the sleeve is about 0.125 inch. The inner diameter of the forward end of the collar is about 0.096 and the outer diameter of the collar at its forward end is about 0.118. The outer diameter of the rearward end of the collar is about 0.132 inch. The length of the collar is about 0.130 inch and the length of the slits and tines is about 0.10 inch. The width of the slits at their forward end is about 0.01 inch.

Figure 3:
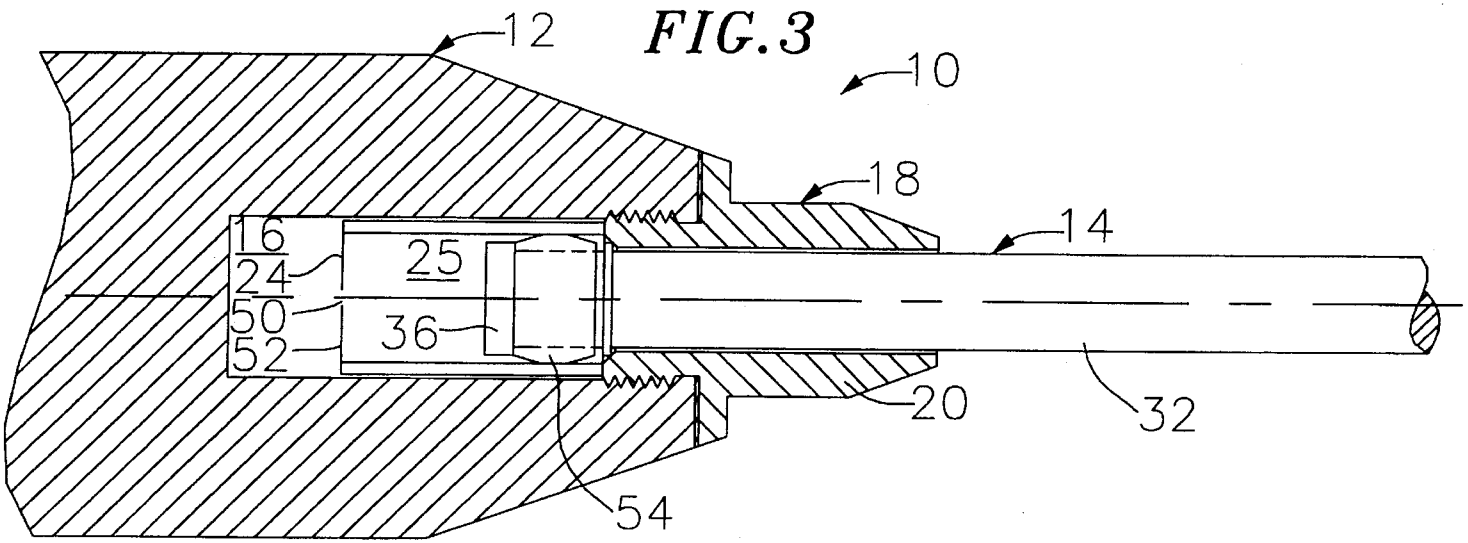
FIG. 3 is a longitudinal cross-sectional cut-away view of another preferred embodiment of the invention; wherein the point is in its extended position.
Figure 4:
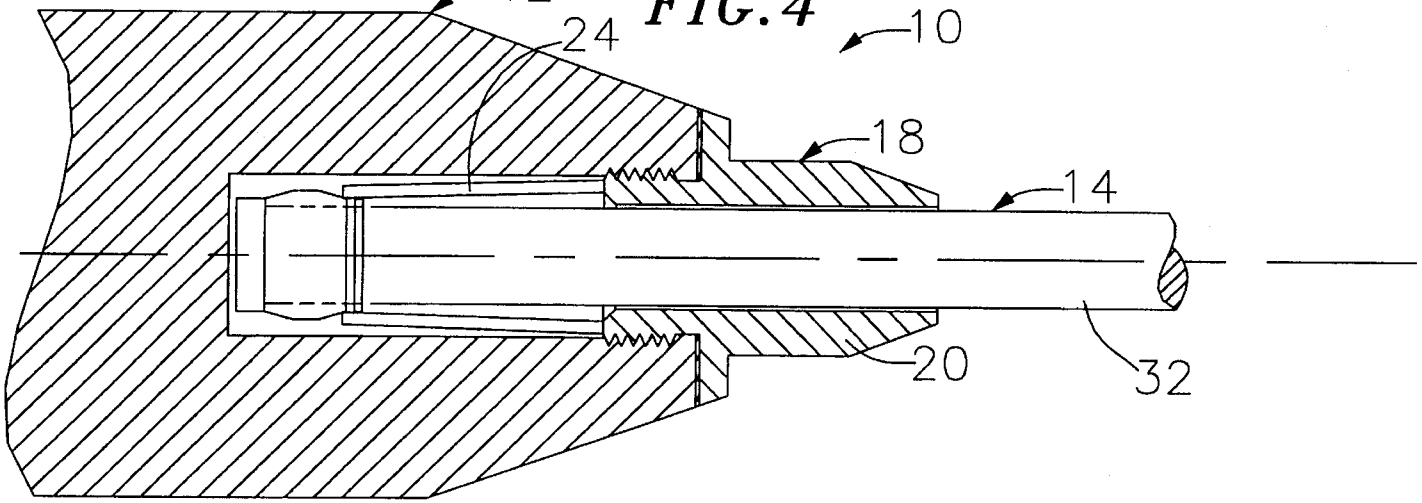
FIG. 4 is a longitudinal cross-sectional cut-away view of the embodiment of FIG. 3 wherein the point is in its retracted position.

FIGS. 3 and 4 show an alternate preferred embodiment of the invention. In this embodiment, the sleeve 24 of the insert 18 comprises four longitudinal slits 50 creating four fingers 52 generally described in U.S. Pat. No. 4,230,322, the disclosure of which is incorporated herein by reference. The fingers 52 extend, from the forward portion of the insert, rearwardly and at least one opposing pair of fingers extend inwardly so that the inner diameter of the sleeve 24 is greater at its forward end than at its rearward end. The fingers frictionally engage a cylindrical collar 54 which is solid, i.e., does not have tines, which is mounted at the rearward end of the point shaft as described above. In this embodiment, the fingers 52 of the sleeve 24 provide the spring force rather than tines on the collar as shown in the embodiment of FIGS. 1 and 2.

Figure 5:
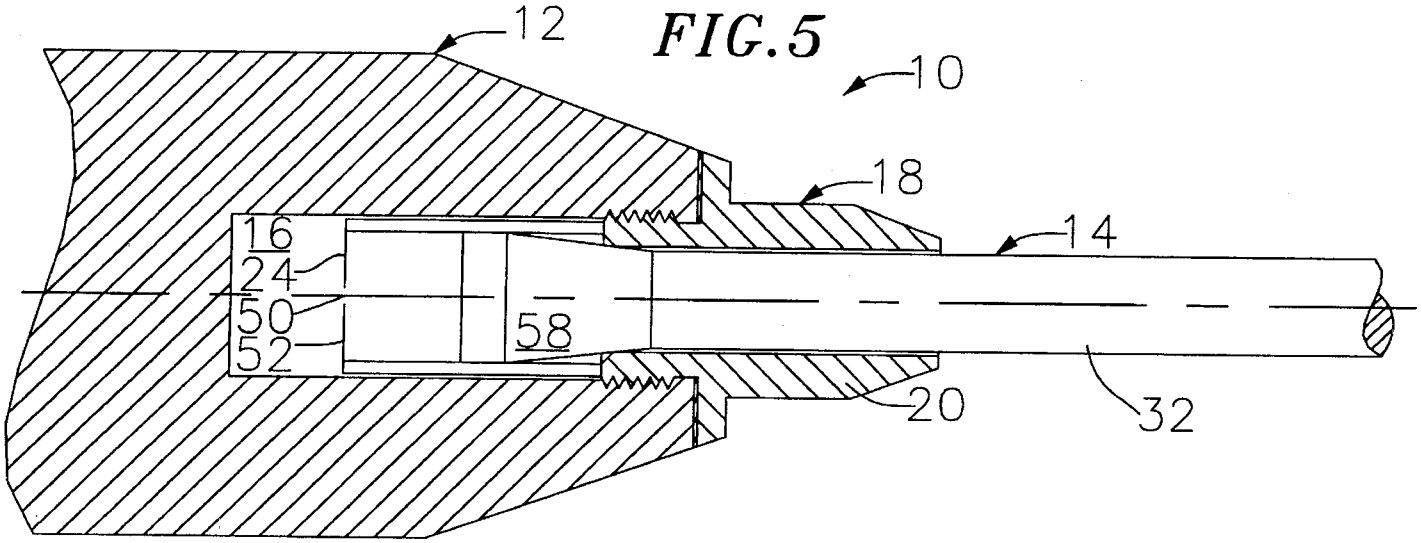
FIG. 5 is a longitudinal cross-sectional cut-away view of another preferred embodiment of the invention wherein the point is in its extended position.
Figure 6:
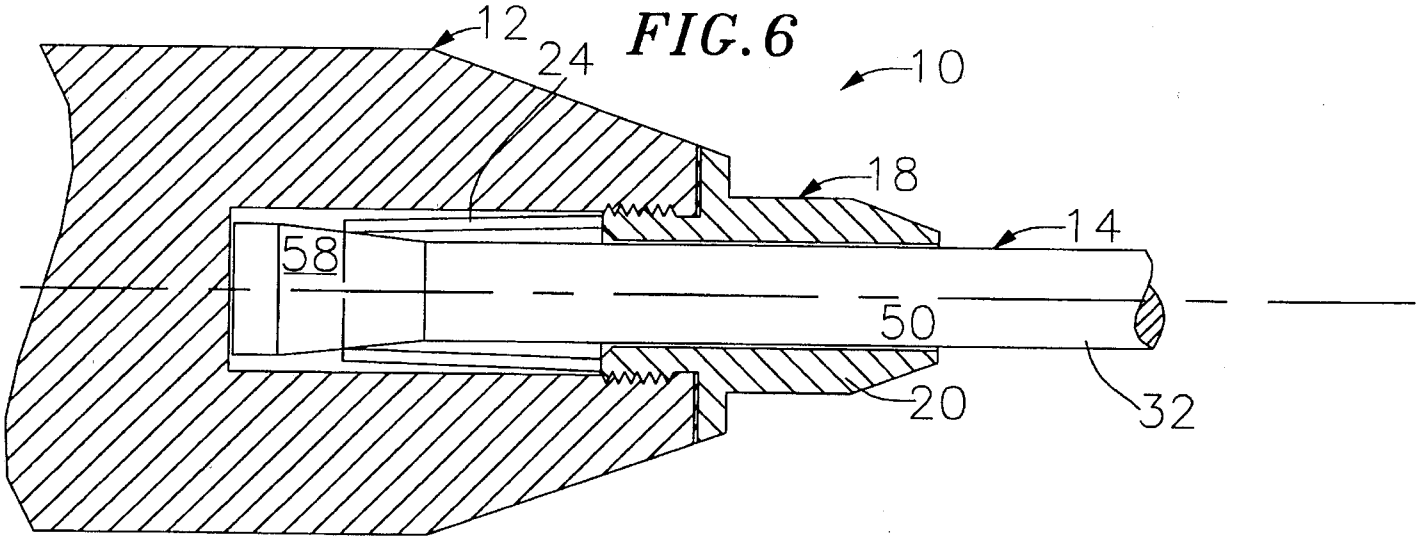
FIG. 6 is a longitudinal cross-sectional cut-away view of the embodiment of FIG. 5 where in the point is in its retracted position.

FIGS. 5 and 6 show yet another embodiment of the invention which affords rotatable movement of the barrel when the point is in its retracted position. In this embodiment, the sleeve 24 comprises fingers 52 as shown in FIG. 3. In this embodiment the fingers 52 frictionally engage an enlarged head 58 at the rearward end of the point shaft. In this embodiment however, the enlarged head 58 is tapered and the depth of the bore is selected so that, when the point is in its retracted position, the enlarged head 58 protrudes out of the sleeve, the rearward ends of the fingers 52 engaging the tapered surface of the head 58 but applying no spring force against it. In this position, the head 58 of the barrel rotates freely about the shaft of the point. The fingers 52 of the sleeve support the rearward end of the point preventing lateral wobbling movement of the barrel with respect to the point.

The preceding description has been presented with reference to the presently preferred embodiments of the invention shown in the drawings. Workers skilled in the art and technology to which this invention pertains will appreciate that alterations and changes in the described structures can be practiced without meaningfully departing from the principal, spirit and scope of the invention.

For example, it is apparent that any means by which a spring force is applied between the point shaft and sleeve maybe utilized in the practice of this invention.

It is apparent for example that, when a rotatable collar is used, the rearward end of the point shaft need not extend beyond the rearward end of the sleeve.

While the preferred embodiments as described incorporate the use of double stick tape to prevent loosening of the insert relative to the barrel, it is understood that such double stick tape is not required. If used, it is preferred that the annular, washer of double stick tape be provided with a release liner. In such a fashion, a dart thrower need only center and press the forward end of the barrel onto the tape and it will stick to the barrel, ready for the insert to be threaded into the barrel and secured against inadvertent loosening by the tape.

Accordingly, the foregoing description should not be read as pertaining only to the precise structures described and shown in the accompanying drawings, but rather should be read consistent with and as support to the following claims which are to have their fullest and fair scope.

What is claimed is:

1. A dart comprising:

a dart barrel having an axial bore at its forward end;

an insert mounted at the forward end of the barrel, said insert having an annular sleeve, having a forward end, a rearward end, an inner surface, and an outer surface, said annular sleeve extending rearwardly into the bore;

a point having a shaft extending through the insert and into the bore, said point afforded slidable lengthwise movement between an extended position and a retracted position;

means for frictionably retarding the entire range of slidable movement of the point from its extended position to its retracted position; and means for allowing the barrel to rotate freely about the point shaft.

2. A dart as recited in claim 1 wherein the frictional retarding means comprises an annular collar mounted in surrounding relation to the rearward end of the point shaft, having a forward end, a rearward end, and an outer surface, wherein at least a portion of said collar engages the inner surface of the annular sleeve generating a spring force and thereby friction.

3. A dart as recited in claim 2 wherein the collar is freely rotatable about the point shaft.

4. A dart as recited in claim 3 further comprising means for preventing longitudinal movement of the collar along the point shaft.

5. A dart as recited in claim 2 wherein the collar is rearwardly and outwardly tapered, wherein the outer surface diameter of the forward end of the collar is smaller than the inner surface diameter of the annular sleeve, wherein the outer surface diameter of the rearward end of the collar is greater than the inner surface diameter of the sleeve but less than the diameter of the bore, and wherein the collar comprises at least a pair of slits, extending rearwardly from a position spaced apart from the forward end of the collar to the rearward end of the collar, to thereby form at least form a pair of tines, so that, when the collar is within the sleeve, the tines exerts a spring force radially outwardly against the inner surface of the annular sleeve to frictionally retard the slidable movement of the point.

6. A dart as recited in claim 5 wherein the collar comprises four slits which form four tines.

7. A dart as recited in claim 2 wherein the means for allowing the barrel to rotate freely about the point shaft comprises a space between the rearward end of the bore and the rearward end of the annular sleeve, so that, when the point is in its retracted position, the portion of the collar which is frictionally engageable with the inner surface of the sleeve lies within the space thereby affording free rotation of the point shaft relative to the barrel.

8. A dart as recited in claim 2 wherein the annular sleeve comprises at least a pair of slits extending from a position spaced apart from the forward end of the sleeve to the rearward end of the sleeve to thereby form at least a pair of fingers, and wherein said fingers extend rearwardly and radially inwardly so that, when the collar is within the sleeve, the fingers exert a spring force against at least a portion of the collar to thereby frictionally retard the movement of the point as it moves from its extended position to its retracted position.

9. A dart as recited in claim 8 wherein the annular sleeve comprises four slits forming four fingers.

10. A dart as recited in claim 8 wherein the means for allowing the barrel to rotate freely about the point shaft comprises a space between the rearward end of the bore and the rearward end of the annular sleeve, so that, when the shaft is in its retracted position, the portion of the collar frictionally engaged by the sleeve fingers lies within the space, thereby affording the rotation of the point shaft relative to the barrel.

11. A dart as recited in claim 1 wherein the frictional retarding means comprises an enlarged head at the rearward end of the point shaft, wherein at least a portion of said enlarged head is frictionally engageable with the inner surface of the annular sleeve.

12. A dart as recited in claim 11 wherein the annular sleeve comprises at least a pair of slits extending from a position spaced apart from the forward end of the sleeve to the rearward end of the sleeve forming at least a pair of fingers, and wherein said fingers extend rearwardly and radially inwardly, so that, when the enlarged head is within the sleeve, the fingers exert a spring force against at least a portion of the enlarged head to thereby frictionally retard movement of the point as it moves from its extended position to its retracted position.

13. A dart as recited in claim 11 wherein the means for allowing the barrel to rotate freely about the point shaft comprises a space between the rearward end of the bore and the rearward end of the annular sleeve, so that, when the shaft is in the retracted position, the portion of the enlarged head frictionally engaged by the sleeve lies within the space, thereby affording free rotation of the point shaft relative to the barrel.

* * * * *